US007263954B2

(12) United States Patent
Piddock et al.

(10) Patent No.: US 7,263,954 B2
(45) Date of Patent: Sep. 4, 2007

(54) INTERNAL COMBUSTION ENGINE COOLANT FLOW

(75) Inventors: Mitchell Piddock, Brentwood (GB); Ian Pegg, Chelmsford (GB); Les Routledge, Essex (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/292,561

(22) Filed: Dec. 2, 2005

(65) Prior Publication Data

US 2006/0162677 A1 Jul. 27, 2006

(30) Foreign Application Priority Data

Dec. 4, 2004 (GB) ..... 0426646.6

(51) Int. Cl.
*F01P 7/16* (2006.01)

(52) U.S. Cl. ..... 123/41.09; 123/41.02; 123/41.08

(58) Field of Classification Search ..... 123/41.02, 123/41.08, 41.1, 41.44, 41.47, 41.09
See application file for complete search history.

(56) References Cited

U.S. PATENT DOCUMENTS 4,369,738 A 1/1983 Hirayama
4,413,596 A * 11/1983 Hirayama ..... 123/41.1
5,036,803 A * 8/1991 Nolting et al. ..... 123/41.1
5,329,889 A * 7/1994 Caldwell ..... 123/41.54
5,505,164 A * 4/1996 Hollis ..... 123/41.1
6,044,808 A 4/2000 Hollis
6,477,989 B2 * 11/2002 Suzuki et al. ..... 123/41.1
6,550,431 B1 * 4/2003 Holmstrom ..... 123/41.54
6,705,586 B2 * 3/2004 Williges ..... 251/129.04
6,758,171 B2 * 7/2004 Hwang ..... 123/41.05
6,837,192 B2 * 1/2005 Shinpo et al. ..... 123/41.1
2006/0162676 A1 * 7/2006 Pegg et al. ..... 123/41.1

FOREIGN PATENT DOCUMENTS

DE 41 09 498 9/1992
GB 2 247 745 3/1992

* cited by examiner

*Primary Examiner*—Stephen K. Cronin
*Assistant Examiner*—Ka Chun Leung
(74) *Attorney, Agent, or Firm*—Gary A. Smith

(57) ABSTRACT

A cooling system for an internal combustion engine 1 is disclosed in which an electronically controlled flow control valve 9 is used to control the flow of coolant exiting the engine 1. The electronically controlled flow control valve 9 is able to control the cooling of the engine 1 irrespective of the speed at which a pump 2 used to urge coolant to flow into the engine 1 is rotated by a drive belt 3 connected to an output 4 from the engine 1.

7 Claims, 4 Drawing Sheets

INTERNAL COMBUSTION ENGINE COOLANT FLOW

This invention relates to cooling systems for internal combustion engines and in particular to a cooling system for a motor vehicle.

A typical motor vehicle or automobile engine cooling system includes an engine coolant jacket, a radiator, a cabin heater matrix, a degas system, a radiator bypass, a fan for drawing air through the radiator, a circulatory pump for circulating the coolant from the engine through the radiator and return.

Such a system typically includes a thermostat, which opens to allow the circulation of the coolant to the radiator when the engine reaches a minimum desired operating temperature. The coolant flow is driven conventionally by a pump rotated by a belt driven by the crankshaft pulley and the flow rate is dependant upon engine speed.

Local combustion chamber wall and the oil film temperatures seen by the piston skirt and rings are controlled predominantly by the engine speed and operating load (heat release rate), charge temperature, pressure and composition and coolant temperature and coolant flow rate.

A major function of the coolant within an engine, besides heat removal is to ensure acceptable temperature gradients are achieved around each cylinder and across the whole engine. This avoids excessive thermal distortion and stresses induced due to the temperature differences. These stresses, especially during warm-up, can lead to low cycle fatigue issues. For this reason, the coolant flow rate requirement will depend on the heat input rate as much as it does on the actual local metal or coolant temperatures. Local boiling and degas requirements also need to be taken into account. Some coolant flow is therefore always needed.

For different vehicle operating conditions and engine speeds and loads there are different considerations to take into account, such as cabin heater performance, fuel economy, emissions, oil film temperature, etc. Adding an additional control to the coolant system on top of a thermostatically controlled valve will help to optimise the local operating temperatures within the engine.

In order to improve engine efficiency different means have been utilised to enable the engine to operate at its highest optimum temperature. For example in U.S. Pat. No. 4,744,335, the engine is provided with a servo controlled flow valve at its coolant outlet. However, the valve used to control the flow is relatively complex in construction and requires the use of additional valves to control its position. This means that the valve is not directly controllable to vary the flow from the engine but relies on the control of a pressure difference across a piston forming part of the valve to regulate the flow.

U.S. Pat. No. 5,975,031 discloses a cooling system having a pump with an electrically driven motor the speed of which is varied with engine temperature. The system disclosed in U.S. Pat. No. 5,975,031 also includes a radiator by-pass duct and discloses the use of a control valve upstream of the pump to control the ratio of the flows of water entering the pump from both the bypass duct and radiator.

It is further known from GB-A-2,377,253 to provide a cooling system for an engine in which the flow of coolant from a pump to the engine is controlled by an electronically controlled flow control valve. This cooling system allows the cooling to the engine to be more accurately controlled but has the disadvantage that the space in the vicinity of the coolant pump is normally very limited and so it is difficult to package such a valve arrangement.

The present invention provides an improved means for controlling the flow of coolant through an engine cooling system using an engine driven coolant pump.

According to the present invention there is provided a cooling system for an internal combustion engine having a coolant circuit through which coolant is circulated by a pump wherein at least one electronically controlled flow control valve is positioned at a coolant outlet from the engine to control the flow of coolant through the engine.

The cooling system may further comprise a radiator to cool coolant passing therethrough and a bypass valve located between a coolant outlet from the engine and an inlet to the radiator to selectively allow coolant to flow through the radiator or bypass the radiator and flow back to the pump depending upon the temperature of the coolant in the cooling circuit and the or each electronically controlled flow control valve is located between the coolant outlet from the engine and an inlet to the bypass valve.

Advantageously, the engine may have a cylinder block and a cylinder head each having an independent coolant flow path therethrough and a first electronically controlled flow control valve is positioned at a coolant outlet from the cylinder block to control the flow of coolant through the cylinder block and a second electronically controlled flow control valve is positioned at a coolant outlet from the cylinder head to control the flow of coolant through the cylinder head.

The or each electronically controlled flow control valve may be controlled by an electronic controller.

The system may further comprise an actuator to operate each electronically controlled flow control valve. In which case, the actuator may be a vacuum operable actuator.

The system may further comprise a sensor associated with each electronically controlled flow control valve for providing a feedback signal indicative of the resistance to flow through the or each electronically controlled flow control valve.

The or each electronically controlled flow control valve may be controlled based upon one or more operating parameters. The operating parameters may include at least one of those selected from vehicle parameters, powertrain parameters and heating and cooling parameters.

Alternatively, the or each electronically controlled flow control valve may be controlled based upon at least one sensed temperature of the engine.

According to a second aspect of the invention there is provided a method for controlling the flow of cooling fluid through the cooling system of an internal combustion engine, the system including a pump to circulate coolant through a cooling circuit forming part of the cooling system, an electronically controlled flow control valve located in the cooling circuit at an outlet from the engine and an electronic controller to control the opening and closing of the electronically controlled flow control valve wherein the method comprises determining a required cooling flow for the engine and opening or closing the electronically controlled flow control valve to provide the required flow.

The electronic controller may be responsive to signals received from a valve position sensor and a plurality of other sensors which monitor a plurality of operating parameters and the method further comprises opening and closing the electronically controlled flow control valve based upon the signal received from the valve position sensor and at least one of the operating parameters. The operating parameters may include at least one of those selected from vehicle parameters, powertrain parameters and heating and cooling parameters.

Alternatively, the electronic controller may be responsive to signals received from at least one engine temperature sensor and the method further comprises opening and closing the electronically controlled flow control valve based upon the signals received from the or each temperature sensor.

Having a valve to restrict the flow at an outlet from the engine has the advantages that any increase in pressure due to the restriction in flow caused by the valve will only increase the pressure in the pump, supply conduits from the pump to the engine and in the engine and will not increase the pressure in the other components of the cooling system such as the radiator or cabin heater, in addition, when the flow is reduced, the pressure in the engine is increased and this will reduce the risk of boiling within the engine. This would not be the case if the valve is at an inlet to the engine as disclosed in GB-A-2,377,253.

The invention will now be described by way of example only with reference to the accompanying drawing of which:

Figure 1:
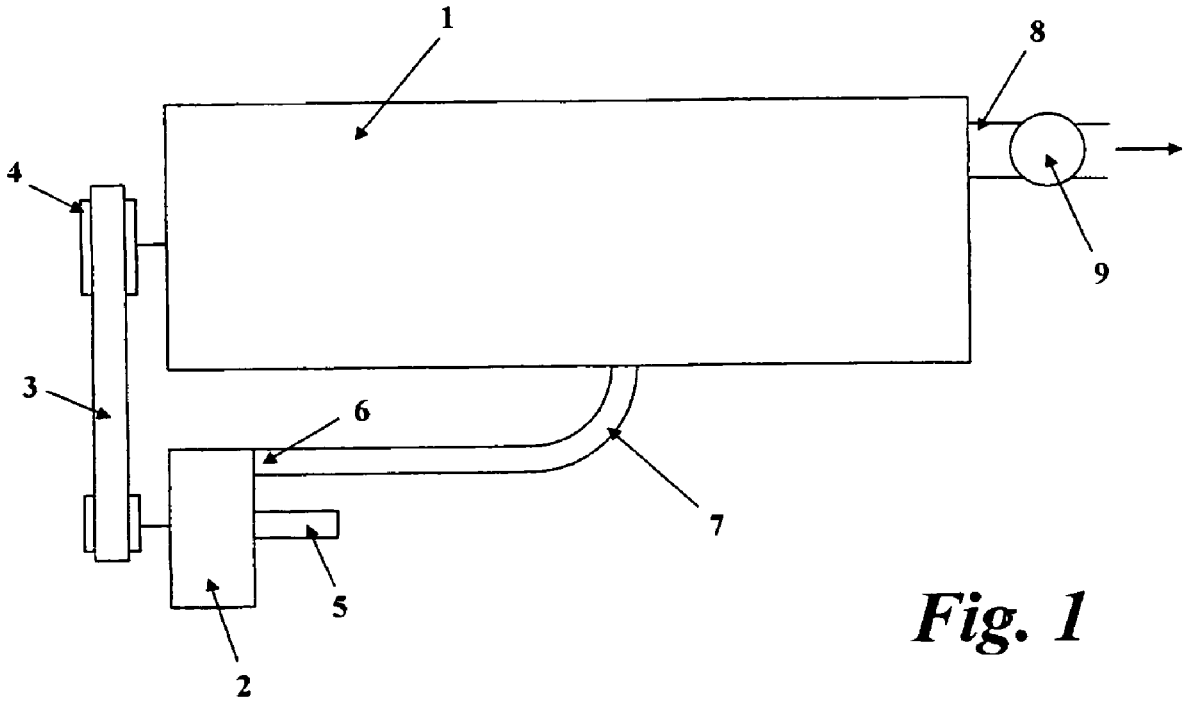
FIG. 1 is a schematic drawing of a simplified engine cooling system according to the invention.

With reference to FIG. 1 there is shown an internal combustion engine 1 having a cooling jacket through which a liquid coolant, typically a water/glycol mix, is pumped.

The coolant is pumped through the engine 1 by a pump 2 mounted externally of the engine 1 and driven by an endless belt 3 driven from a pulley 4 secured to a crankshaft of the engine 1. The coolant enters the pump 2 through an inlet conduit 5 from a radiator and is pumped out from a pump outlet 6 into the engine 1 via a conduit 7.

The coolant exits the engine through a coolant outlet 8 and passes to an electronically controlled flow control valve 9 before flowing to the inlet of a bypass valve or thermostat and then to a radiator for cooling. The electronically controlled flow control valve 9 is controlled to produce the minimum flow restriction in order to ensure the lowest pump power consumption is used for the required cooling if a fixed displacement pump is used or a small capacity pump if an impellor type pump is used.

Figure 3:
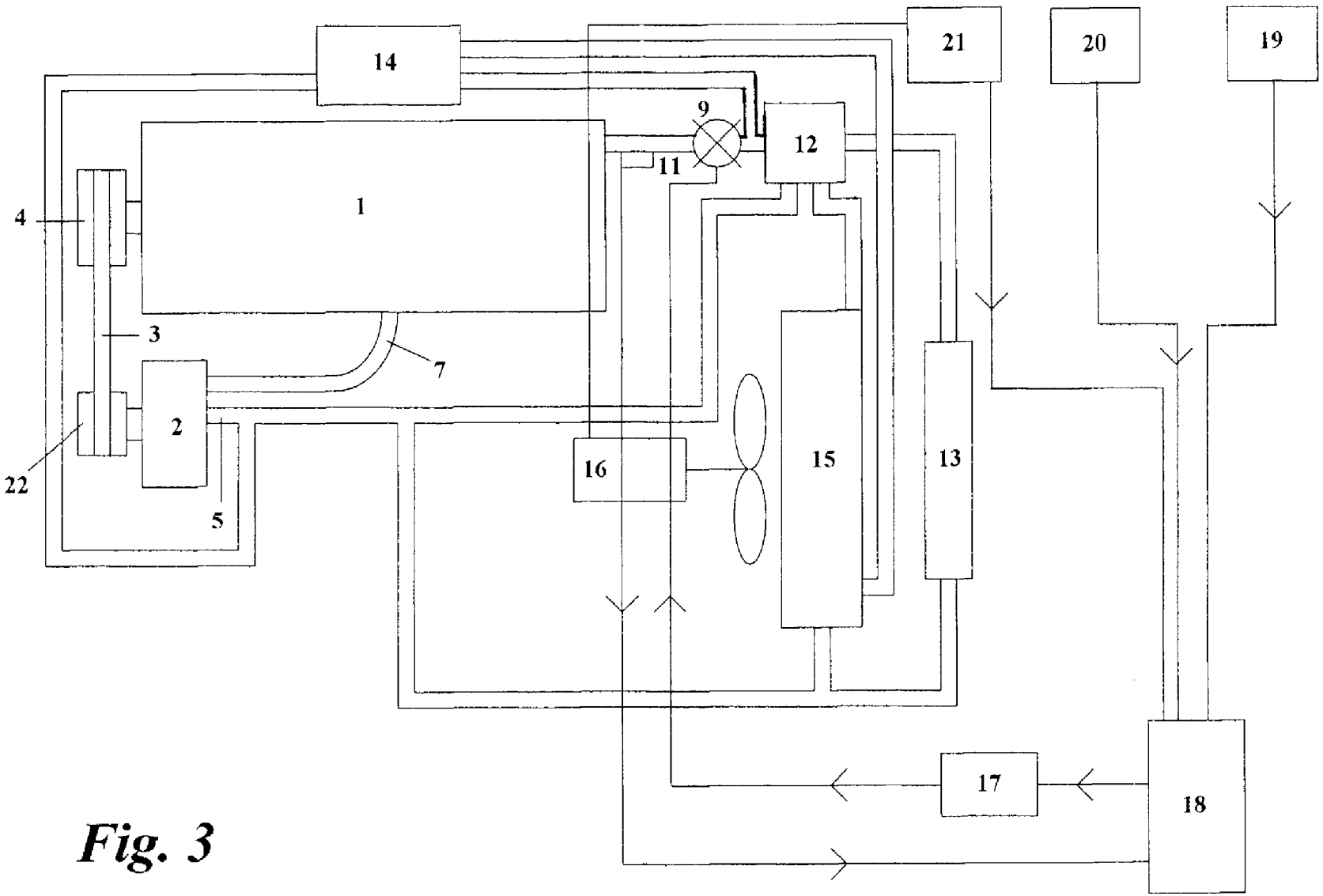
FIG. 3 is a drawing similar to FIG. 1 but showing the cooling system in greater detail.

With reference to FIG. 3 there is shown in greater detail a cooling system as previously described with reference to FIG. 1 and for which the same reference numerals are used for identical parts.

The coolant is pumped into the engine 1 and the heated coolant exits the engine 1 and passes through a flow restricting valve in the form of an electronically controlled flow control valve 9. The amount of coolant that can flow through the engine is determined by the position of the flow-restricting valve 9. The flow regulating or restricting valve 9 may be of any suitable type which causes minimum flow restriction when fully open such as, for example, a flap valve, a ball valve, or plate valve. In this case, as can be seen with reference to FIG. 2, an electronically controlled flap valve 9 is used.

The valve 9 is operated by an actuator 10, which again may be of any suitable type, for example hydraulic, electrical, or preferably a vacuum actuator, which operate by a vacuum source on the vehicle. The actuator 10 is biased to a valve open condition so that the valve 9 restricts coolant flow only when the actuator is energised and is open in the case of a failure of the actuator 10. The valve condition is monitored by a sensor in the form of a rotary potentiometer 11 and an end position sensor in the form of a micro-switch (not shown) is used to provide a signal indicative of the fact that the flap valve 9 is fully closed. It will be appreciated that a physical end stop could also be used to provide a reference position.

It will be appreciated that even when the valve 9 is in a fully closed position, coolant may be able to flow pass the valve 9 in order to prevent the engine 1 and or pump 2 being starved of coolant.

After passing through the valve 9 the coolant then passes to the inlet of a bypass valve in the form of a thermostat 12 and, if thermostat 12 is closed, then flows through a radiator bypass circuit back to engine 1 via the inlet conduit 5 to the pump 2. The coolant also flows from the thermostat 12 through a heat exchanger 13 for heating the vehicle passenger compartment and through a degas reservoir or bottle 14 back to engine 1 via the pump 2. The circuit may also include an exhaust gas recirculation cooler (not shown) which would be inserted into the heater circuit in a suitable location.

The supply to the degas reservoir 14 is from an inlet to the thermostat 12 so that this position is between the valve 9 and the thermostat 12. It will be appreciated that the flow of coolant through the engine 1 is controlled separately to the operation of the temperature controlled thermostat 12 and that by positioning the connection to the degas reservoir 14 after the valve 9 the system will automatically provide a low pressure and flow to the degas reservoir whenever the flow from the engine 1 is being restricted such as it will be during engine warm up. This is advantageous as the less flow there is through the degas reservoir 14 the less cold coolant will be pushed out of the degas reservoir 14 to slow up engine warm up and reduce cabin heater 13 performance.

When the thermostat 12 is opened flow will be directed through the vehicle radiator 15, rather than the bypass circuit thereby cooling the coolant before it is returned to the engine 1.

It will be appreciated that other forms of valve could be used for the bypass valve instead of a thermostat but that a temperature sensing thermostat provides a low cost reliable means of providing bypass flow that is self controlling.

A cooling fan 16 is used to draw cooling air through the radiator 15.

The valve actuator 10 is operated by a valve control unit 17, which receives control signals from an electronic controller in the form of a cooling system control module 18. In the embodiment disclosed the valve control unit 17 and the cooling system control module 18 are shown as separate components but it will be appreciated that the valve control unit 17 could be formed as a part of the cooling system control module 18.

The control module 18 receives input signals from a plurality of different sources. Firstly, the module 18 receives a valve position signal from the sensor 11 to complete a control loop for the valve 9. The actual valve position will be determined in response to other engine condition signals and to parameters which may be programmed into an engine map.

The other sensors may be divided into three types, vehicle parameter 19, powertrain parameters 20 and heating and cooling parameters 21.

The vehicle parameter sensors 19 may include torque demand sensor e.g. accelerator pedal position, gear, speed and ignition key status.

The powertrain sensors 20 may include sensors for engine air intake temperature, cylinder head metal body temperature (CHT), block metal temperature, engine coolant outlet temperature, cylinder head gasket temperature, engine speed, engine air flow, and engine fuel demand.

The heating and cooling sensors 21 may include ambient air temperature, ambient pressure, air conditioning, passenger compartment temperature settings and fan control settings, and radiator fan status.

The above lists of sensors are by way of example only and the invention is not limited to the use of such sensors.

The control module 18 processes the input signals from the various sensors and determines the optimum coolant flow rate required. The control module 18 then, by using either an algorithm or pre-programmed maps, estimates the desired flow for the current engine speed and load.

The control module 18 sends a signal to the valve control unit 17 indicative of the required coolant flow rate and, by using either an algorithm or one or more pre-programmed maps, the valve position required to achieve this flow rate is determined. The valve actuator 10 is then activated to increase or decrease the flow through the valve 9 dependant upon the desired valve 9 position and the current valve position. That is to say if the valve is currently 75% open and a valve opening of 50% is required to produce the desired flow then the valve 9 would be closed by the actuator 10 but if the required flow requires a valve opening of 80% then the actuator 10 would open the valve 9.

Therefore in this way, by adding coolant flow rate control to the thermostatically controlled valve 12 allows better control of the local temperatures/heat transfer whilst still avoiding excessive distortion/stresses and local boiling.

In an alternative control methodology, the valve position is controlled not by reference to other operating parameters but directly in a closed loop manner by using one or more temperature sensors (not shown) fitted to the engine 1. The cooling system control module 18 receives these signals and determines whether the current temperatures as provided by the engine mounted sensors are too high or too low compared to a reference set-point temperature. If the temperatures are too high then a signal is sent to the valve control unit 17 to open the valve 9 and conversely if the temperatures are too low then the control unit 17 is instructed to close the valve 9. In this way the flow of coolant through the engine 1 can be controlled directly to optimise its efficiency and emission performance.

For example, if a temperature sensor is positioned to sense the temperature of the coolant leaving the engine 1 and a further temperature sensor is mounted near to a wall of one of the cylinders of the engine 1, then the coolant sensor can be used to determine when the coolant temperature is below a predetermined minimum temperature as would be encountered during engine warm up. This signal can be used by the cooling control module 18 to maintain the valve 9 shut to assist with engine warm-up. Similarly, the cylinder bore sensor can be used to control the valve 9 when the engine is running normally with hot coolant to control the flow through the engine 1 so as to maintain the cylinder wall temperature close to a desired temperature which will produce low friction but will not adversely compromise the life of the oil used to lubricate the engine 1.

It will be appreciated that one of the advantages of a cooling system according to this invention is that it can be easily fitted because the valve 9 is located on the outlet side of the engine 1 and the outlet is normally positioned near to an upper end of the engine 1 where there is more available space.

It will also be appreciated that the positioning of the valve at the outlet of the engine before it reaches any other components of the cooling system means that if the valve is closed to restrict flow then it is only the pump, the engine and any conduits used to connect the pump to the engine that are subject to the increased pressure caused by restricting the flow and the other components are subject to low pressure.

It will also be appreciated that a valve of the type shown could easily be fitted to an existing engine design with little additional work or expense. The only significant additions would be the valve itself, an electronic controller used to control the valve and any additional sensors required to provide feedback to the electronic controller.

Figure 4:
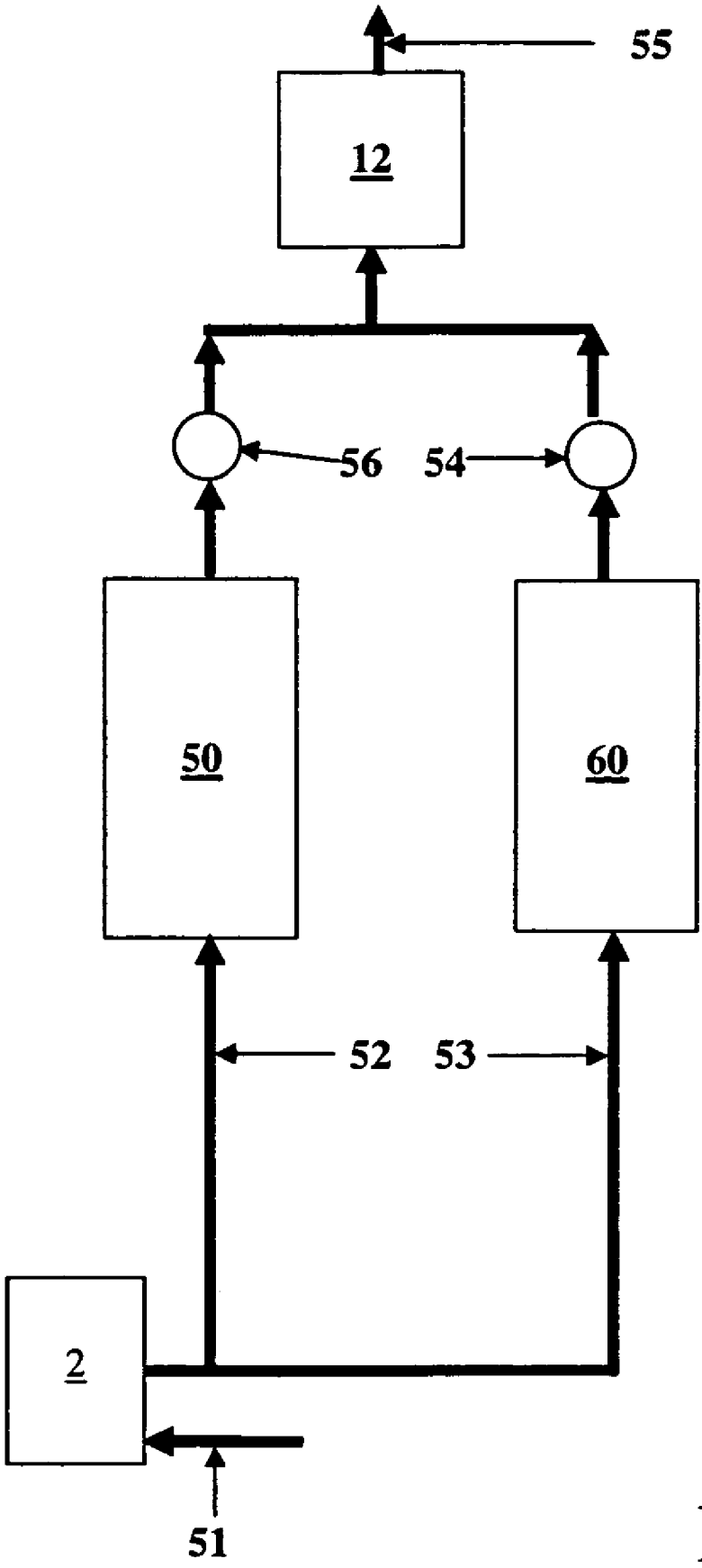
FIG. 4 is a schematic drawing of a second embodiment of a cooling system according to the invention.

With reference to FIG. 4 there is shown part of a second embodiment of a cooling system for an engine which is in many respects the same as that previously described.

As before a pump 2 is used to circulate coolant through an engine to a thermostat 12 and from there via various conduits (generally indicated by reference numeral 55) back to an inlet conduit 51 to the pump 2. It will be appreciated that as before the cooling system will include a radiator, cabin heater and degas reservoir but these have been omitted from FIG. 4.

The primary difference between this embodiment and the embodiment previously described is that the coolant flow through the engine is divided into two separate flow paths.

One of the flow paths includes a first coolant supply conduit 52, a first electronically controlled flow control valve 56 and a common return to the thermostat 12 and is used to provide coolant to a cylinder block 50 of the engine.

The second flow path includes a second coolant supply conduit 53, a second electronically controlled flow control valve 54 and a common return to the thermostat 12 and is used to provide coolant to a cylinder head 60 of the engine.

This arrangement provides improved control over the embodiment previously described because the flow of coolant through the cylinder block 50 of the engine can be controlled separately from the coolant flow through the cylinder head 60.

Figure 2:
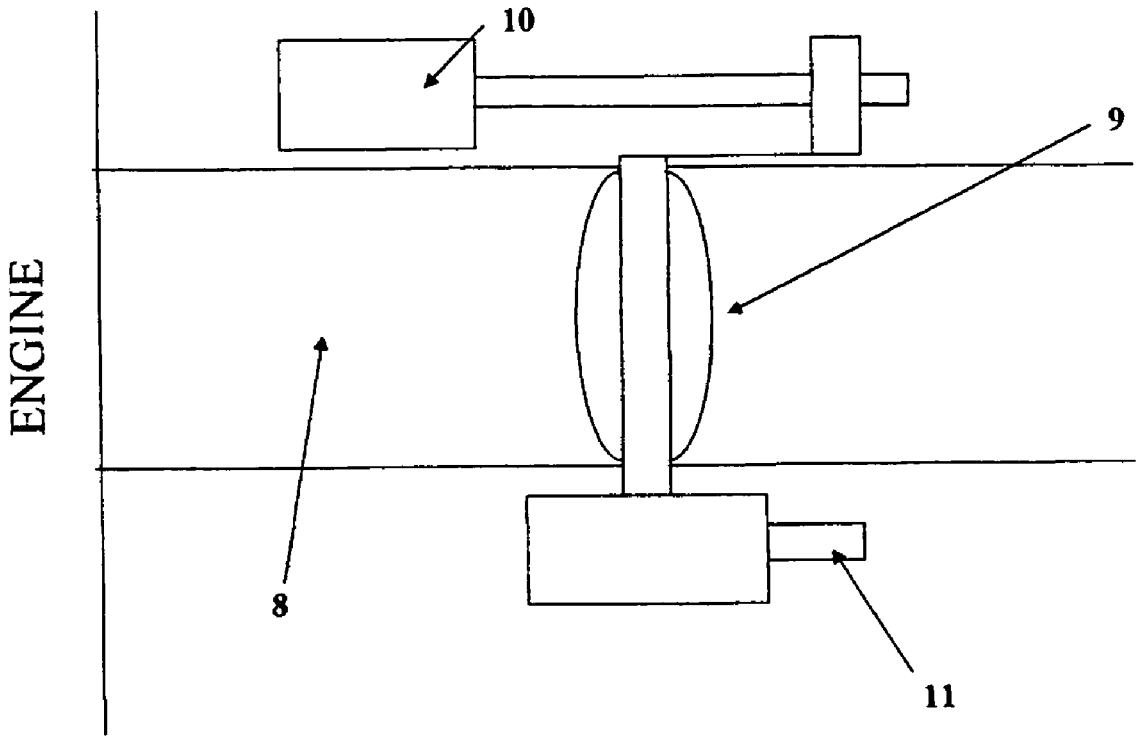
FIG. 2 is a schematic drawing of a control valve arrangement forming part of a cooling system according to the invention.

Both of the electronically controlled flow control valves 54, 56 are controlled by an electronic controller (not shown) and are of a similar construction to that shown in FIG. 2.

This embodiment is advantageous in that it is desirable to maintain the oil used to lubricate the engine within a predetermined range in order to maximise its performance. If the temperature of the oil is too high then the oil will rapidly degrade but if the temperature is too low then friction will increase. By using a temperature sensor positioned on the cylinder block close to a wall of a cylinder of the engine it is possible to provide an indication of oil temperature which can be used to control the flow of coolant through the cylinder block 50 so as to maintain it within a predetermined range by selectively opening or closing the first electronically controlled flow control valve 56.

Similarly, a temperature sensor can be fitted to the cylinder head to measure the temperature in the region of a critical component such as in the region of a valve bridge so that the temperature can be controlled to provide the best possible engine performance It will be appreciated that it is desirable for the cylinder head to operate at a high temperature in order to reduce emissions from the engine but if the temperature is too high it will result in premature failure of one or more components of the cylinder head 60.

If the cooling supplied to the cylinder head 60 is independently controlled then it is possible to maximise the operating temperature without risking any failures whereas in the case of a conventional linked cooling system, in which the coolant flows from the cylinder block to the cylinder head before returning to the pump, the coolant flow has to be a compromise between providing a desired cylinder block temperature and a desired cylinder head temperature.

Although the flows from the two electronically controlled flow control valves 54, 56 are shown connected to a common bypass valve or thermostat 12 it will be appreciated that a separate bypass valves could be used for the cylinder head 60 and the cylinder block 50.

Therefore in summary, a cooling system is disclosed in which one or more electronically controlled flow control valves are used to control the flow of coolant exiting an engine and thereby control the cooling of the engine irrespective of the speed at which a pump used to urge coolant to flow into the engine is rotated by a drive belt connected to an output from the engine.

It will be appreciated that heat loss due to degas flow rate and leakage past thermostat are reduced by controlling the flow via the electronically controlled flow control valve before the thermostat opens.

By making use of the plurality of sensors and the additional control due to the presence of the electronically controlled flow control valve or valves, improved warm-up rates can be achieved whilst managing the thermal expansion during warm-up to within acceptable levels.

If the pump is an impellor type pump then controlling the coolant flow via one or more electronically controlled flow control valves will reduce the power consumed by the coolant pump because the increased back pressure will cause the flow through the pump to stall as the maximum pump pressure is reached.

It will be appreciated by those skilled in the art that although the invention has been described by way of example with reference to a number of specific embodiments it is not limited to these embodiments and that various alternative embodiments or modifications to the disclosed embodiments could be made without departing from the scope of the invention.

The invention claimed is:

1. A cooling system for an internal combustion engine comprising a pump to circulate coolant through the engine, a radiator to cool coolant passing therethrough, a thermostat controlled bypass valve located between a coolant outlet from the engine and an inlet to the radiator to selectively allow coolant to flow through the radiator or bypass the radiator and flow back directly to the pump depending upon the temperature of the coolant flowing through the bypass valve and at least one electronically controlled flow control valve located between the coolant outlet from the engine and an inlet to the bypass valve to control the flow of coolant passing to the bypass valve, and the system further comprising a degas reservoir to remove gas from the coolant circulating through the cooling system, the degas reservoir being connected at one end to the cooling system at a position between an outlet from the or each electronically controlled valve and an inlet to the bypass valve and begin connected at an opposite end to a inlet conduit to the pump.

2. A cooling system as claimed in claim 1 wherein the at least one electronically controlled flow control valve is controlled by an electronic controller.

3. A cooling system as claimed in claim 2 wherein the electronic controller is operative based upon one or more operating parameters including at least one of those selected from vehicle parameters, powertrain parameters and heating and cooling parameters.

4. A cooling system as claimed in claim 2 wherein the or each electronically controlled flow control valve is controlled by the electronic controller based upon at least one sensed temperature of the engine.

5. A cooling system as claimed in claim 1 wherein the system further comprises a sensor associated with each electronically controlled flow control valve for providing a feedback signal indicative of the resistance to flow through the or each electronically controlled flow control valve.

6. A cooling system as claimed claim 1 wherein the system further comprises an actuator to operate each electronically controlled flow control valve.

7. A cooling system for an internal combustion engine comprising a pump to circulate coolant through the engine, a radiator to cool coolant passing therethrough, a thermostat controlled bypass valve located between a coolant outlet from the engine and an inlet to the radiator to selectively allow coolant to flow through the radiator or bypass the radiator and flow back directly to the pump depending upon the temperature of the coolant flowing through the bypass valve and at least one electronically controlled flow control valve located between the coolant outlet from the engine and an inlet to the bypass valve to control the flow of coolant passing to the bypass valve, the system further comprising a sensor associated with the or each electronically controlled flow control valve for providing a feedback signal indicative of the resistance to flow through the or each electronically controlled flow control valve.

* * * * *